US006677837B2

(12) United States Patent
Kojima et al.

(10) Patent No.: US 6,677,837 B2
(45) Date of Patent: Jan. 13, 2004

(54) DIELECTRIC WAVEGUIDE FILTER AND MOUNTING STRUCTURE THEREOF

(75) Inventors: Hiroshi Kojima, Hiki-Gun (JP); Hiroyuki Katoh, Hiki-Gun (JP); Meiji Miyashita, Hiki-Gun (JP); Kazuhisa Sano, Hiki-Gun (JP)

(73) Assignee: Toko, Inc., Tokyo (JP)

( * ) Notice: Subject to any disclaimer, the term of this patent is extended or adjusted under 35 U.S.C. 154(b) by 0 days.

(21) Appl. No.: 10/193,642

(22) Filed: Jul. 11, 2002

(65) Prior Publication Data

US 2003/0016100 A1 Jan. 23, 2003

(30) Foreign Application Priority Data

Jul. 17, 2001 (JP) ..... 2001-216919
Jul. 25, 2001 (JP) ..... 2001-223765
Jun. 7, 2002 (JP) ..... 2002-166381

(51) Int. Cl.[7] ..... H01P 1/20

(52) U.S. Cl. ..... 333/208; 333/26; 333/219.1; 333/134; 333/212

(58) Field of Search ..... 333/203, 26, 219.1, 333/134, 212

(56) References Cited

U.S. PATENT DOCUMENTS

| | | | | | |
|---|---|---|---|---|---|
| 4,740,765 | A | | 4/1988 | Ishikawa et al. | 333/206 |
| 5,499,004 | A | | 3/1996 | Noguchi et al. | 333/202 |
| 5,600,740 | A | * | 2/1997 | Asfar | 333/208 |
| 5,737,696 | A | | 4/1998 | Yorita | 455/83 |
| 5,929,726 | A | | 7/1999 | Ito et al. | 333/206 |
| 6,002,307 | A | | 12/1999 | Arakawa | 333/135 |
| 6,031,433 | A | * | 2/2000 | Tanizaki et al. | 333/208 |
| 6,133,808 | A | * | 10/2000 | Arakawa | 333/208 |
| 6,380,824 | B1 | | 4/2002 | Nishijima et al. | 333/134 |
| 6,549,103 | B2 | * | 4/2003 | Jilong | 333/208 |
| 6,600,392 | B2 | * | 7/2003 | Kim et al. | 333/208 |

FOREIGN PATENT DOCUMENTS

| | | | |
|---|---|---|---|
| EP | 0525416 A1 | 2/1993 | H01P/1/205 |
| EP | 0 855 757 | 7/1998 | |
| EP | 0856902 A2 | 8/1998 | H01P/1/208 |
| EP | 0859423 A1 | 8/1998 | H01P/1/208 |
| JP | 11195905 | 7/1999 | H01P/1/208 |
| JP | 11225004 | 8/1999 | H01P/1/208 |
| JP | 02000196305 A | 7/2000 | H01P/1/20 |
| JP | 2000-135003 | 5/2002 | |

OTHER PUBLICATIONS

Yoshihiro Konishi, "Novel Dielectric Waveguide Components–Microwave Applications of New Ceramic Materials", Proceedings of the IEEE, New York. vol. No. 6, Jun. 1991, pp. 726–740.

* cited by examiner

*Primary Examiner*—Michael Tokar
*Assistant Examiner*—Lam T. Mai
(74) *Attorney, Agent, or Firm*—Cohen, Pontani, Lieberman & Pavane

(57) ABSTRACT

The present invention provides a dielectric waveguide filter comprising a plurality of dielectric waveguide resonators in the form of rectangular parallelepiped-shaped blocks aligned as a single main body having opposite ends defined by respective the end blocks located thereat, and a pair of input and output electrodes provided in the end blocks, respectively. Each of the end blocks is formed with a protruding portion including a dielectric substance extended from that therein. A conductive strip line extending from the bottom surface of corresponding one of the end blocks to the edge region of the bottom surface of corresponding one of the protruding portions. The bottom surfaces have a region where the dielectric substance in contact with the both sides of the conductive strip line is exposed to outside. The conductive strip lines are coupled with micro-strip lines or co-planer lines on a printed circuit board having a given length to obtain an adequate matching between input and output signals.

7 Claims, 5 Drawing Sheets

DIELECTRIC WAVEGUIDE FILTER AND MOUNTING STRUCTURE THEREOF

FIELD OF THE INVENTION

The present invention relates to a dielectric waveguide filter and a mounting structure thereof. In particular, the present invention relates to a structure for mounting a dielectric waveguide filter having input and output electrodes to a printed circuit board formed with a conductive pattern to be brought into contact with the input and output electrodes.

BACKGROUND OF THE INVENTION

Various dielectric waveguide filters can be obtained by variously coupling a plurality of dielectric waveguide resonators. In conventional dielectric waveguide filters, their input and output electrodes have been provided, for example, by forming conductive patterns in the sidewalls of dielectric resonators, or forming through holes in the dielectric resonators. However, such conventional structures of the input and output electrodes have suffered from mismatching in input and output sections due to poor continuity or connectivity at a connection area between the input and output electrodes and lines on a printed circuit board.

Considering this disadvantage, the applicant has proposed an improved structure of input and output electrodes in Japanese Patent Application No. 2000-329046 wherein a conductive strip (strip line) 85 made of a conductive film is provided in each of both end of dielectric block comprising a plurality of dielectric waveguide resonators as shown in FIGS. 8 and 9, and the conductive strip 85 are coupled with a conductive strip line 86 on a printed circuit board 86'.

However, this structure has need of extending each of the conductive strip up to the end surface of the dielectric block, and thereby the end face inevitably includes a region to which the dielectric substance of the dielectric block is exposed without forming a conductive film thereon. Such an exposed region of the dielectric substance causes leakage of electromagnetic field in the resonators, and the resulting radiation loss leads to significantly increased filer loss. In addition, desirable filter characteristics cannot be maintained without strict control of the positioning between the conductive strip and the conductive strip line.

SUMMARY OF THE INVENTION

It is therefore an object of the present invention to provide a dielectric waveguide filter capable of being desirably mounted on a printed circuit board with minimized discontinuity between input and output electrodes of the filter and a signal line on the printed circuit board so as to reduce undesirable losses otherwise caused by reflection or radiation of electromagnetic field at input and output sections.

It is another object of the present invention to provide a structure for mounting a dielectric waveguide filter to a printed circuit board, capable of achieving enhanced productivity with a simplified structure.

It is still another object of the present invention to provide a dielectric waveguide filter capable of maintaining its desirable characteristics even if some displacement occurs between a printed circuit board and the dielectric waveguide filter mounted on the printed circuit board.

In order to achieve the above object, the present invention is directed to provide an improved input and output structure for dielectric waveguide resonators, and further improve on the structure of a conductive pattern in a printed circuit board for mounting the dielectric waveguide resonators thereon.

Specifically, according to a first aspect of the present invention, there is provided a dielectric waveguide filter comprising a plurality of dielectric waveguide resonators in the form of rectangular parallelepiped-shaped blocks aligned as a single main body having opposite ends defined by respective the end blocks located thereat, and a pair of input and output electrodes provided in the end blocks, respectively, the main body having an outer surface including a bottom surface. In this dielectric waveguide filter, each of the end blocks is formed with a protruding portion including a dielectric substance extended from that therein, the protruding portion having an outer surface including a bottom surface and an end surface extending upward from the edge of the bottom surface. Each of the input and output electrodes is defined by a conductive strip line extending from the bottom surface of corresponding one of the end blocks to the edge region of the bottom surface of corresponding one of the protruding portions. These bottom surfaces have a region where the dielectric substance in contact with the both sides of the conductive strip line is exposed to outside. The end surface of the protruding portion has a region where the dielectric substance in contact with the conductive strip line is exposed to outside. Further, the outer surfaces of the main body and the protruding portions is covered with a conductive film excepting the regions where the dielectric substance in contact with the conductive strip line is exposed to outside.

According to a second aspect of the present invention, there is provided a structure for mounting a dielectric waveguide filter on a printed circuit board. In this mounting structure, based on the structure of the dielectric waveguide filter according to the first aspect of the present invention, the printed circuit board includes a pair of conductive patterns to be connected to the input and output electrodes, respectively, and the conductive patterns are formed on printed circuit board in alignment with one another. Further, the distance between the opposed ends of the conductive patterns is arranged to be less than the distance between the opposite outer edges of said input and output electrodes on the side of said end surfaces.

As above, the fundamental feature of a dielectric waveguide filter according to the present invention is as follows.

A. A plurality of dielectric waveguide resonators in the form of rectangular parallelepiped-shaped blocks aligned as a single main body having opposite ends defined by the end blocks located thereat.

B. A protruding portion provided to each of the end blocks serving as input and output terminals.

C. A conductive strip line extending from the bottom surface of corresponding one of the end blocks to the edge region of the bottom surface of corresponding one of said protruding portions.

In a specific embodiment of the present invention, conductive patterns each having the same width as that of each of the strip lines of the dielectric waveguide filter is formed on a printed circuit board, and each of the conductive patterns is arranged to terminate within the bottom surface of the main body. Thus, signals from the printed circuit board are coupled with a resonant mode in the dielectric waveguide filter by connecting the strip lines to the conductive lines. Each of the conductive patterns may be formed to extend between the opposing inner edges of the strip lines or input and output electrodes. In this case, even if the dielectric waveguide filter is mounted to the printed circuit board with some displacement in the longitudinal direction of the conductive pattern, the filter characteristics has no adverse effect.

In order to prevent the dielectric substance from being exposed to outside at a position closed to the dielectric waveguide resonators, each outer edge of the input and output electrodes of the dielectric waveguide filter can be shifted to a position away from dielectric waveguide resonators or the main body without forming the outer edges of the input and output electrodes in the end surfaces of the main body. Thus, the input and output electrodes or the conductive strip lines may extend up to the end surfaces of corresponding the protruding portions.

The dielectric waveguide filter according to the present invention can be mounted on a printed circuit board with enhanced continuity between input and output electrodes of the filter and a signal line on the printed circuit board, and thereby undesirable losses otherwise caused by reflection or radiation of electromagnetic field at input and output sections can be minimized. The mounting operation of the dielectric waveguide filter is also facilitated. In addition, the dielectric waveguide filter according to the present invention can be achieved only by modifying the configuration of the dielectric substance of the dielectric waveguide resonators. This advantageously provides lowered time and cost for designing.

Other features and advantages of the present invention will be apparent from the accompanying drawings and from the detailed description.

DESCRIPTION OF THE PREFERRED EMBODIMENT

Figure 1:
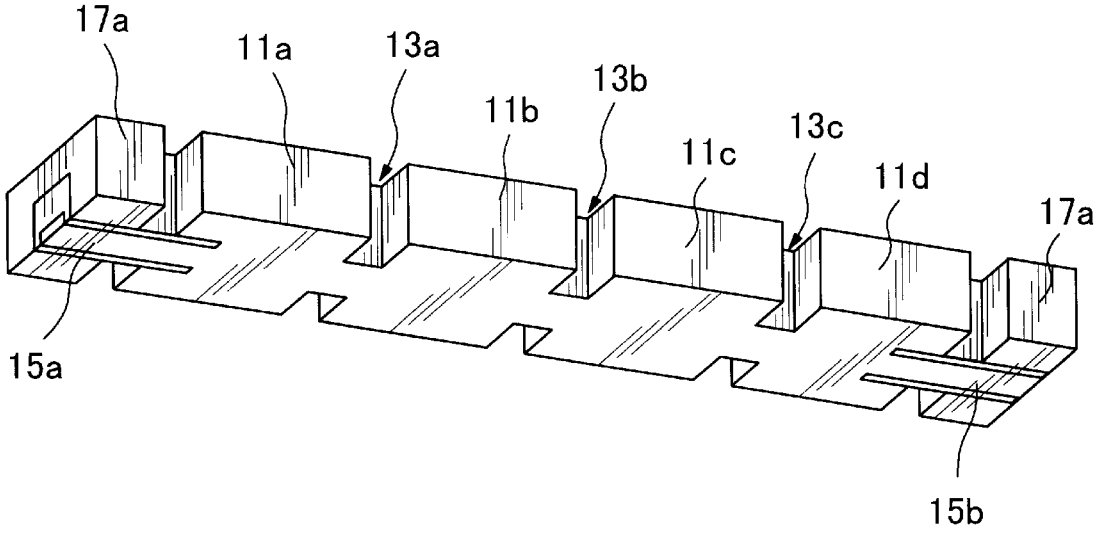
FIG. 1 is a perspective view showing a dielectric waveguide filter according to one embodiment of the present invention.

With reference to the drawings, various embodiments of the present invention will now be described. FIG. 1 is a perspective view showing a dielectric waveguide filter according to one embodiment of the present invention. A main body of the dielectric waveguide filter comprises four dielectric waveguide resonators composed of rectangular parallelepiped-shaped dielectric blocks 11*a,* 11*b,* 11*c,* 11*d,* and respective electromagnetic couplings between the dielectric waveguide resonators are controlled in an adequate range by slits 13*a,* 13*b,* 13*c.* In this embodiment, a pair of protruding portions 17*a,* 17*b* are formed on the end surfaces of the dielectric blocks or end block 11*a,* 11*d* located at both ends of the main body, respectively. Each of the protruding portions includes the same dielectric substance as that of the main body or a dielectric substance extended from that of the main body. A pair of conductive strip lines 15*a,* 15*b* serving as input and output electrodes are formed in the same plane or the bottom surfaces of the main body and the protruding portions. Each of the conductive strip lines 15*a,* 15*b* extends from the bottom surface of corresponding one of the end blocks 11*a,* 11*b* to the edge of the bottom surface of corresponding one of the protruding portions 17*a,* 17*b,*

Figure 2:
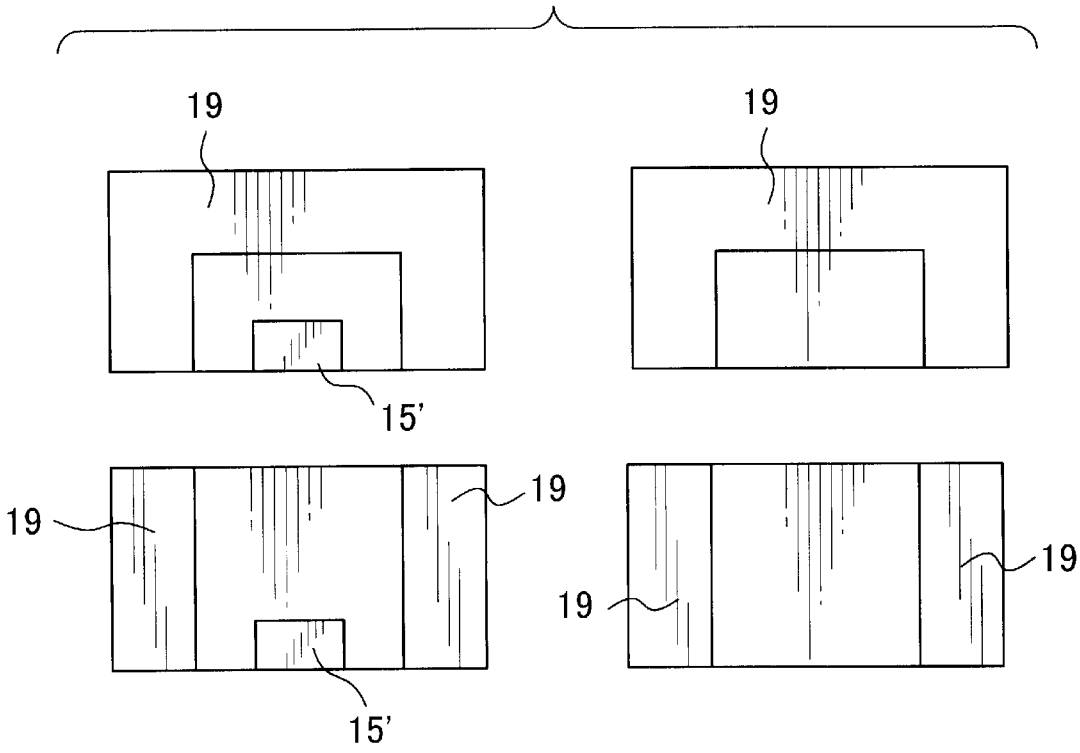
FIG. 2 is an end view showing various patterns of the end surface of a dielectric waveguide filter according to the present invention.

The bottom surfaces of the end blocks and the protruding potions have a region where the dielectric substance in contact with the both sides of the conductive strip line 15*a,* 15*a* is exposed to outside. This is done to allow the conductive strip lines 15*a,* 15*b* to be connected to input and output signal lines. FIG. 2 shows examples of a conductive pattern in the end surface of the protruding portion. As seen in FIG. 2, a conductive film 19 connected to the ground is formed not to connect to the conductive strip line. The conductive strip line may extend up to the end surface of the protruding portion to form a conductive pattern 15'.

Figure 3:
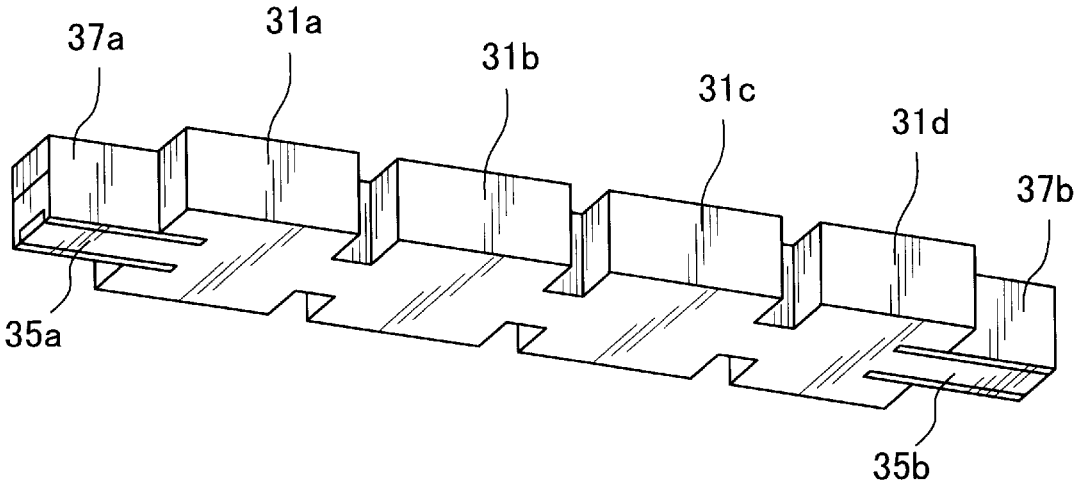
FIG. 3 is a perspective view showing a dielectric waveguide filter according to another embodiment of the present invention.
Figure 4:
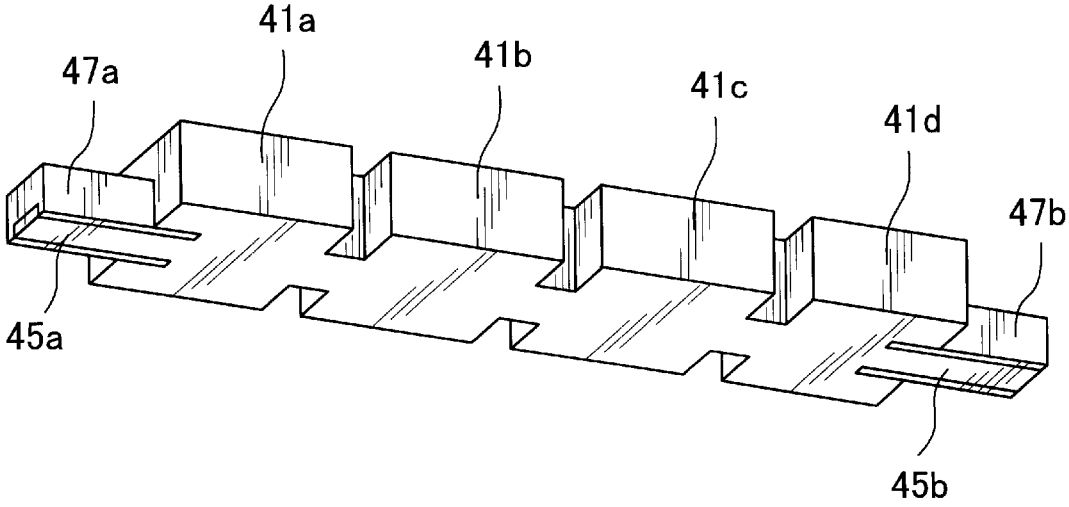
FIG. 4 is a perspective view showing a dielectric waveguide filter according to another embodiment of the present invention.

FIG. 3 is a perspective view showing a dielectric waveguide filter according to another embodiment of the present invention. In this embodiment, of each of the protruding portions 37*a,* 37*b* has smaller width than those of the protruding portions 17*a,* 17*b* in the aforementioned embodiment. In another embodiment shown in FIG. 4, each of protruding portions 47*a,* 47*b* has also smaller width and height or smaller entire dimension. It is to be understood that any other suitable configuration may be applied to the protruding portion.

Figure 5:
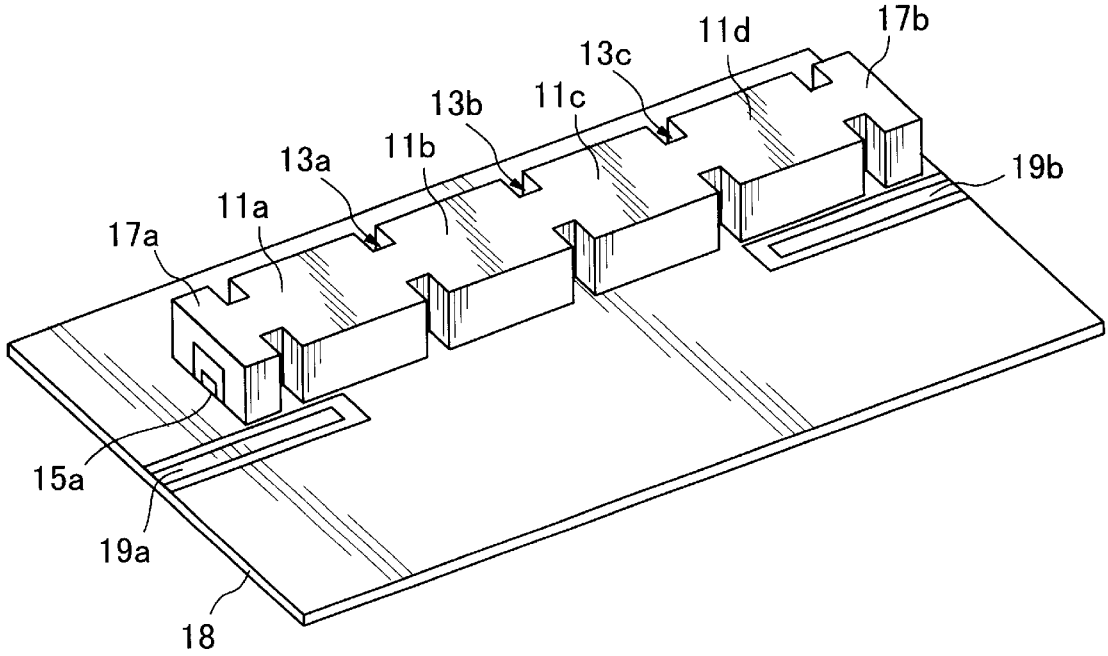
FIG. 5 is a perspective view showing a dielectric waveguide filter and a printed circuit board according to another embodiment of the present invention.

FIG. 5 is a perspective view showing a structure for mounting a dielectric waveguide filter on a printed circuit board, according to the present invention. In this embodiment, the dielectric waveguide filter has the same structure as that of the embodiment shown in FIG. 1. A pair of conductive patterns 19*a,* 19*b* are formed on the printed circuit board 18 in alignment with each other, these conductive patterns are connected to the strip lines 15*a,* 15*b* of the dielectric waveguide filter, respectively.

Figure 6:
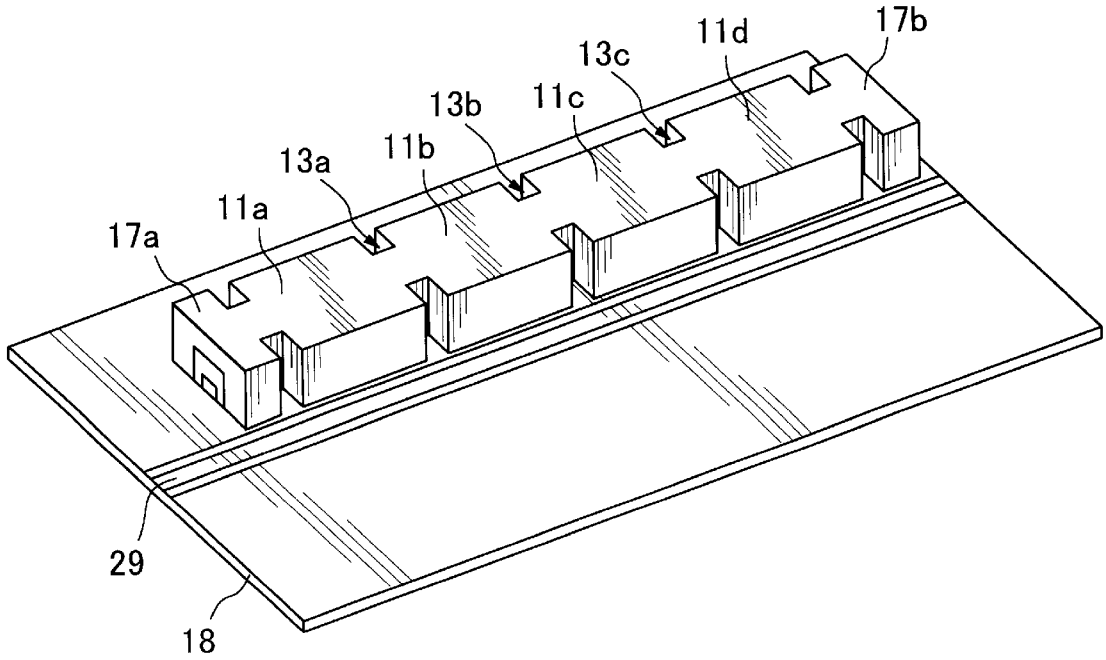
FIG. 6 is a perspective view showing a dielectric waveguide filter and a printed circuit board according to another embodiment of the present invention.

In the dielectric waveguide filter according to the present invention, each of the conductive patterns 19*a,* 19*b* is arranged to extend inwardly over the position of the inner edge of corresponding one of the strip lines 15*a,* 15*b.* Thus, even if the dielectric waveguide filter or the dielectric waveguide resonators are mounted to the printed circuit board with some displacement in the longitudinal direction of the conductive pattern, the filter characteristics has no adverse effect. As shown in FIG. 6, the conductive patterns on the printed circuit board may be integrated into a single linear conductive pattern 29.

The operation of the dielectric waveguide filter according to the present invention will be described below. A conductive pattern such as micro-strip lines or co-planer lines formed on a printed circuit board will be formed in configuration capable of keeping a desirable continuity to the conductive strip lines serving as the input and output electrodes of the dielectric waveguide filter according to the present invention. The conductive pattern is also terminated between respective inner edges of the input and output electrodes of the dielectric waveguide filter to supply input and output signals through the bottom surface of the dielectric waveguide filter.

The input signal causes magnetic field in the dielectric waveguide resonators, and the magnetic field is coupled with a magnetic field of a primary resonant mode of the dielectric waveguide resonators, and consequently the external circuit is coupled with the resonators. The coupling structure of the present invention can keep a desirable continuity between the signal lines of the printed circuit board and the input and output electrodes of the filter. Thus, undesirable reflection of high frequency signals otherwise cause by discontinuity can be suppressed.

Each of the protruding portions provided with the input and output terminals has a smaller dimension than that of each of the dielectric waveguide resonators. Thus, the protruding portions act as barrier to the primary mode frequency of the dielectric waveguide resonators. This prevents electromagnetic field at a resonant frequency from leaking outside, which provides lowered loss.

Figure 7:
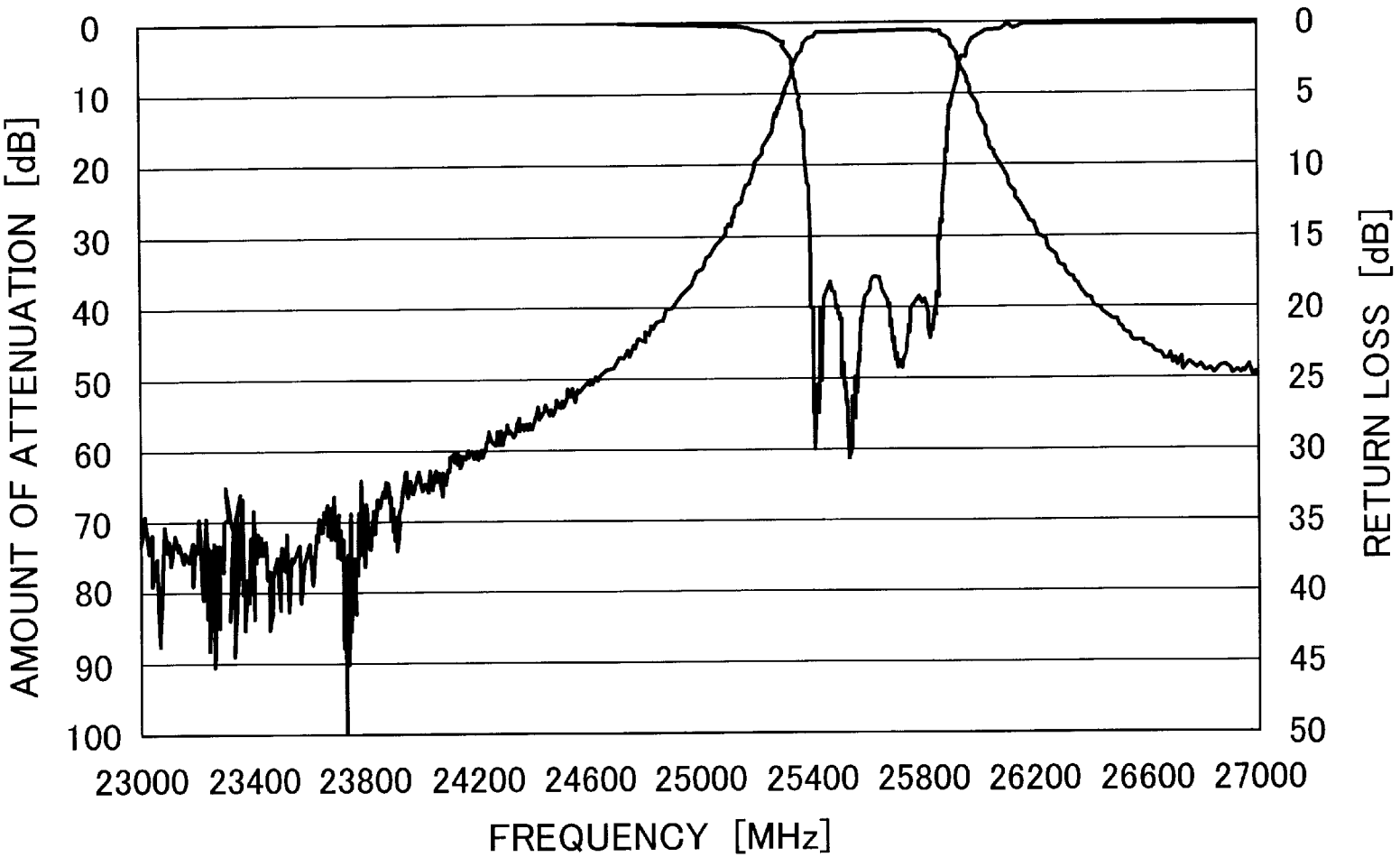
FIG. 7 is an explanatory diagram showing characteristics of a dielectric waveguide filter according to the present invention.
Figure 8:
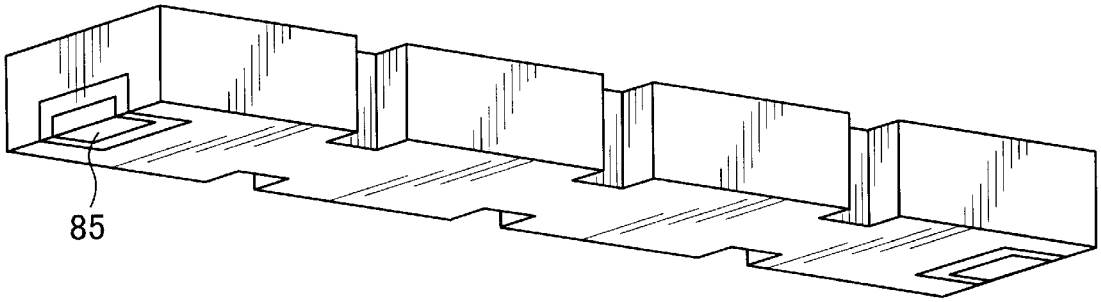
FIG.8 (PRIOR ART)
FIG. 8 is a perspective view showing a conventional dielectric waveguide filter.
Figure 9:
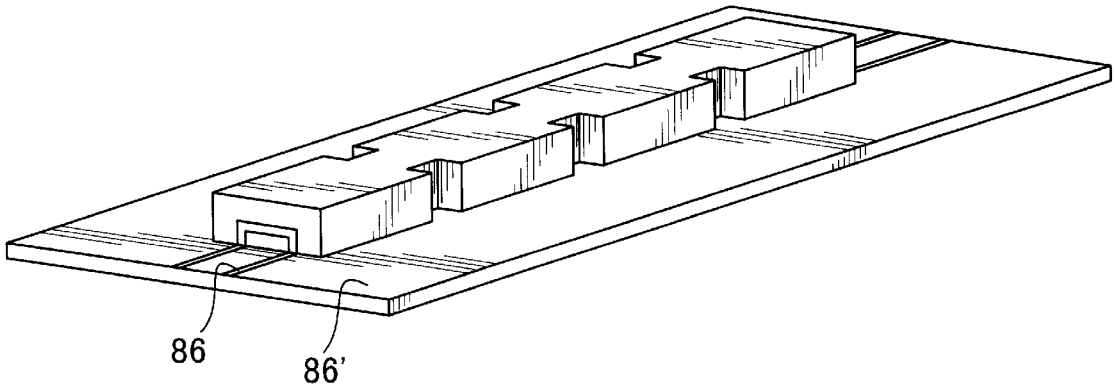
FIG.9 (PRIOR ART)
FIG. 9 is a perspective view showing a conventional dielectric waveguide filter and printed circuit board.

An example of four elements prepared as the dielectric waveguide filter according to the present invention will be described below. Using a dielectric block having an entire length of 18.8 mm, a width of 4.1 mm, and a height of 2.6 mm, a filter having the same structure as that in FIG. 1 was prepared. Each width of the conductive strip lines serving as the input and output electrodes was set in 0.68 mm, and the width of the region of exposing the dielectric substance along both sides of each of the conductive strip lines was set in 1.78 mm. Then, the filter was mounted on the printed circuit board shown in FIG. 6. As a result, it was proved that desirable filter characteristics could be obtained with smaller ripple over 25 GHz band and enhanced attenuation characteristic in other band, as shown in FIG. 7.

The dielectric waveguide filter according to the present invention employs a structure having enhanced continuity to input and output signal lines and allowing the signal lines to be terminated in the bottom surface of the resonators. Thus, as the conductive patter on the printed circuit board (printed printed circuit board) for mounting the filter thereon, any other suitable pattern may be used as long as the electrical end of each of the electrodes on the bottom of the resonators is not changed. For example, the filter may be mounted on a continuous conductive line as described above. This provides enhanced compatibility to variation in dimension of the filter due to modification of the specifications.

What is claimed is:

1. A dielectric waveguide filter comprising a plurality of dielectric waveguide resonators in the form of rectangular parallelepiped-shaped blocks aligned as a single main body having opposite ends defined by respective the end blocks located thereat, and a pair of input and output electrodes provided in said end blocks, respectively, said main body having an outer surface including a bottom surface, said dielectric waveguide filter being characterized in that:

each of said end blocks is formed with a protruding portion including a dielectric substance extended from that therein, said protruding portion having an outer surface including a bottom surface and an end surface extending upward from the edge of said bottom surface;

each of said input and output electrodes is defined by a conductive strip line extending from the bottom surface of corresponding one of said end blocks to the edge region of the bottom surface of corresponding one of said protruding portions, wherein said bottom surfaces have a region where said dielectric substance in contact with the both sides of said conductive strip line is exposed to outside;

the end surface of said protruding portion has a region where said dielectric substance in contact with said conductive strip line is exposed to outside; and the outer surfaces of said main body and said protruding portions is covered with a conductive film excepting said regions where the dielectric substance in contact with said conductive strip line is exposed to outside.

2. A dielectric waveguide filter as defined in claim 1, wherein said input and output electrodes are connected to a micro-strip line formed on a printed circuit board.

3. A dielectric waveguide filter as defined in claim 1, wherein said input and output electrodes are connected to a coplanar line formed on a printed circuit board.

4. A structure for mounting a dielectric waveguide filter on a printed circuit board, said dielectric waveguide filter comprising a plurality of dielectric waveguide resonators in the form of rectangular parallelepiped-shaped blocks aligned as a single main body having opposite ends defined by respective the end blocks located thereat, and a pair of input and output electrodes provided in said end blocks, respectively, said main body having an outer surface including a bottom surface, said mounting structure being characterized in that:

each of said end blocks is formed with a protruding portion including a dielectric substance extended from that therein, said protruding portion having an outer surface including a bottom surface and an end surface extending upward from the edge of said bottom surface;

each of said input and output electrodes is defined by a conductive strip line extending from the bottom surface of corresponding one of said end blocks to the edge region of the bottom surface of corresponding one of said protruding portions, wherein said bottom surfaces have a region where said dielectric substance in contact with the both sides of said conductive strip line is exposed to outside;

the end surface of said protruding portion has a region where said dielectric substance in contact with said conductive strip line is exposed to outside;

the outer surfaces of said main body and said protruding portions is covered with a conductive film excepting said regions where the dielectric substance in contact with said conductive strip line is exposed to outside; and said printed circuit board includes a pair of conductive patterns to be connected to said input and output electrodes, respectively, said conductive patterns being formed on printed circuit board in alignment with one another, wherein the distance between the opposed ends of said conductive patterns is arranged to be less than the distance between the opposite outer edges of said input and output electrodes on the side of said end surfaces.

5. A structure as defined in claim 4, wherein each of said conductive patterns on said printed circuit board is a micro-strip line.

6. A structure as defined in claim 4, wherein each of said conductive patterns on said printed circuit board is a coplanar line.

7. A structure as defined in claim 4, wherein said conductive patterns to be connected to said input and output electrodes is integrated into a single linear conductive pattern to allow the distance between the opposed ends of the conductive patterns to be zero.

* * * * *